US005607006A

United States Patent [19]

Koch

[11] Patent Number: 5,607,006

[45] Date of Patent: Mar. 4, 1997

[54] CASTING METHOD AND APPARATUS FOR USE THEREIN

[75] Inventor: Byron W. Koch, Toledo, Ohio

[73] Assignee: Doehler-Jarvis Technologies, Inc., Toledo, Ohio

[21] Appl. No.: 339,356

[22] Filed: Nov. 14, 1994

[51] Int. Cl.[6] ..... B22D 19/08

[52] U.S. Cl. ..... 164/112; 164/333; 164/334

[58] Field of Search ..... 164/112, 332, 164/333, 334; 267/167

[56] References Cited

U.S. PATENT DOCUMENTS

| | | | |
|---|---|---|---|
| 3,468,527 | 9/1969 | Mather | 267/1 |
| 3,501,320 | 3/1970 | Pietryka et al. | 106/38.27 |
| 4,146,082 | 3/1979 | Granger | 164/254 |
| 4,206,799 | 6/1980 | McDonald | 164/341 |
| 4,273,182 | 6/1981 | Winterhalter et al. | 164/137 |
| 4,375,282 | 3/1983 | Herold | 249/175 |
| 4,436,139 | 3/1984 | Strader | 164/112 |
| 4,592,405 | 6/1986 | Allen | 164/120 |
| 4,655,274 | 4/1987 | Dannoura | 164/341 |
| 4,655,462 | 4/1987 | Balsells | 277/164 |
| 4,678,210 | 7/1987 | Balsells | 285/318 |
| 4,691,754 | 9/1987 | Trumbauer et al. | 164/9 |
| 4,727,922 | 3/1988 | Nakano | 164/61 |
| 4,759,399 | 7/1988 | Saito et al. | 164/126 |
| 4,774,990 | 10/1988 | Yamamoto et al. | 164/14 |
| 4,804,290 | 2/1989 | Balsells | 403/326 |
| 4,805,943 | 2/1989 | Balsells | 285/318 |
| 4,825,933 | 5/1989 | Voss et al. | 164/255 |
| 4,826,144 | 5/1989 | Balsells | 267/167 |
| 4,830,344 | 5/1989 | Balsells | 267/167 |
| 4,876,781 | 10/1989 | Balsells | 29/173 |
| 4,890,937 | 1/1990 | Balsells | 384/16 |
| 4,893,795 | 1/1990 | Balsells | 267/1.5 |
| 4,906,109 | 3/1990 | Balsells | 384/26 |
| 4,907,788 | 3/1990 | Balsells | 267/168 |
| 4,913,217 | 4/1990 | Koch et al. | 164/340 |
| 4,915,366 | 4/1990 | Balsells | 267/167 |
| 4,934,666 | 6/1990 | Balsells | 267/1.5 |
| 4,942,917 | 7/1990 | Koch et al. | 164/369 |
| 4,961,253 | 10/1990 | Balsells | 29/173 |
| 4,964,204 | 10/1990 | Balsells | 29/173 |
| 4,974,821 | 12/1990 | Balsells | 267/167 |
| 4,981,168 | 1/1991 | Koch et al. | 164/137 |
| 5,119,881 | 6/1992 | Cagle | 164/137 |
| 5,205,339 | 4/1993 | Perrella | 164/113 |
| 5,213,150 | 5/1993 | Sensenstein | 164/404 |
| 5,233,859 | 9/1993 | Sbrana | 72/370 |

FOREIGN PATENT DOCUMENTS

| | | | |
|---|---|---|---|
| 4-339556 | 11/1992 | Japan | 164/332 |

*Primary Examiner*—Kuang Y. Lin

*Attorney, Agent, or Firm*—Emch, Schaffer, Schaub & Porcello Co., L.P.A.

[57] ABSTRACT

A method for casting metals around an article having a bore extending along a central axis and defined at least in part by an interior cylindrical wall portion utilizes a mandrel having a cylindrical exterior surface portion sized to be slidingly positioned in said bore in close relationship with said interior cylindrical wall portion. The mandrel has an annular groove in which is positioned a canted coil spring with a series of outer contact points extending radially outwardly beyond said cylindrical exterior surface portion. The article is moved onto the mandrel to compress the spring and deflect the outer contact points such that the spring imparts an outwardly directed force to the article interior cylindrical wall portion to provide frictional resistance between the spring, outer contact points and the interior cylindrical wall portion to retain the article on the mandrel while casting molten metal around the mandrel supported article to form a cast part.

15 Claims, 5 Drawing Sheets

CASTING METHOD AND APPARATUS FOR USE THEREIN

BACKGROUND ART

The present invention is directed to a method and apparatus for casting metals around an article having a bore extending along a central axis and defined at least in part by an interior cylindrical wall portion. The invention utilizes a mandrel having a cylindrical exterior surface portion sized to be slidingly positioned in the bore in close relationship with the interior cylindrical wall portion. The mandrel has an annular groove in which is positioned a canted coil spring with a series of outer contact points extending radially outwardly beyond the cylindrical exterior surface portion. The article is moved onto the mandrel to compress the spring and deflect the outer contact points such that the spring imparts an outwardly directed force to the article interior cylindrical wall portion to provide frictional resistance between the spring outer contact points and the interior cylindrical wall portion to retain the article on the mandrel while casting molten metal around the mandrel supported article to form a cast part. The present invention can be used with a variety of types of casting including sand casting, permanent mold casting, low pressure casting and die casting. It is, for example, suitable for die casting an engine block having a separately formed liner cast therein and a mandrel for use in die casting having means for holding a liner thereon and to a dowel for holding a mandrel thereon. The invention is particularly well-suited for use when the mandrel and dowel are disposed in a vertical position or a position approaching vertical during the die casting operation.

In die casting aluminum engine blocks, steel liners for the cylinder bores are positioned around the mandrels during the casting operation so that upon completion of the casting operation, the steel liners become an integral part of the cast engine block. The liners are cylindrical sleeves with a smooth cylindrical interior surface within which the piston moves during operation of the engine. During the die casting operation, the liners are retained on and snugly engage the cylindrical exterior surface of the mandrels. Cylinder liners can be made of steel, cast iron, powdered metal or any material suitable for engine block manufacture. When the mandrels are maintained in a vertical position or a position approaching vertical, it is necessary to provide a holder for retaining the sleeve on the mandrel. The holder for retaining the sleeve must not impede the flow of molten aluminum into the molding cavity or otherwise interfere with the die casting operation. Additionally, upon completion of the die casting operation, the holder must permit the mandrel to be easily withdrawn from the liner without damaging it or the newly cast part.

Similarly, the mandrel is supported on a dowel and means must be provided for retaining the mandrel on the dowel particularly when they are maintained in a vertical position or a position approaching vertical.

DISCLOSURE OF THE INVENTION

In accordance with the present invention, a new and unique mandrel and liner holder/mandrel combination is provided along with a method for casting using such mandrel for retaining the liner. The mandrel has an outwardly facing annular groove in which is positioned a canted coil spring of a size such that the outer peripheral extent of such canted coil spring extends radially outwardly beyond the cylindrical exterior surface of the mandrel but is resiliently deflectable within the groove upon positioning of a liner over the mandrel in sliding engagement with the cylindrical exterior surface. As a result of such resilient deflection, there is provided an outwardly directed force against the portions of the liner interior surface contacted by the coils of the spring substantially completely around the circumference of such interior surface. The canted coil spring provides a circumferential resilient engagement with the liner with sufficient force to maintain the liner on the mandrel without supplementary holding means even when such parts are vertically positioned and when subject to the broad range of temperatures required in a die casting operation.

Additionally, under a second embodiment, the mandrel is provided with an inwardly facing annular groove in which is positioned a second canted coil spring extending circumferentially within the groove and having a diameter defined by the innermost portions thereof which is smaller than the diameter of the cylindrical interior surface of the mandrel. Under the second embodiment, prior to placement of the mandrel over the dowel, the canted coil spring will have a minor portion of each coil which extends radially inwardly from the cylindrical interior surface of the mandrel throughout substantially the full circumferential extent of the spring. Upon placement of the mandrel on a dowel sized to slide within the mandrel in close proximity to the cylindrical interior surface, the canted coil spring will be resiliently deflected and will be maintained in engagement with the dowel following its insertion therein. The coils of the canted coil spring are urged outwardly away from the axis of the mandrel and provide an inwardly directed force against those portions of the outer surface of the dowel contacted by the coils of the spring. As a result, the canted coil spring provides a circumferential resilient frictional engagement sufficient to maintain the mandrel on the dowel without slipping even when such parts are vertically positioned with no other means for supporting the mandrel on the dowel.

A method for casting engine blocks and other parts utilizing mandrels and the holders is also provided.

BEST MODE OF CARRYING OUT INVENTION

Figure 1:
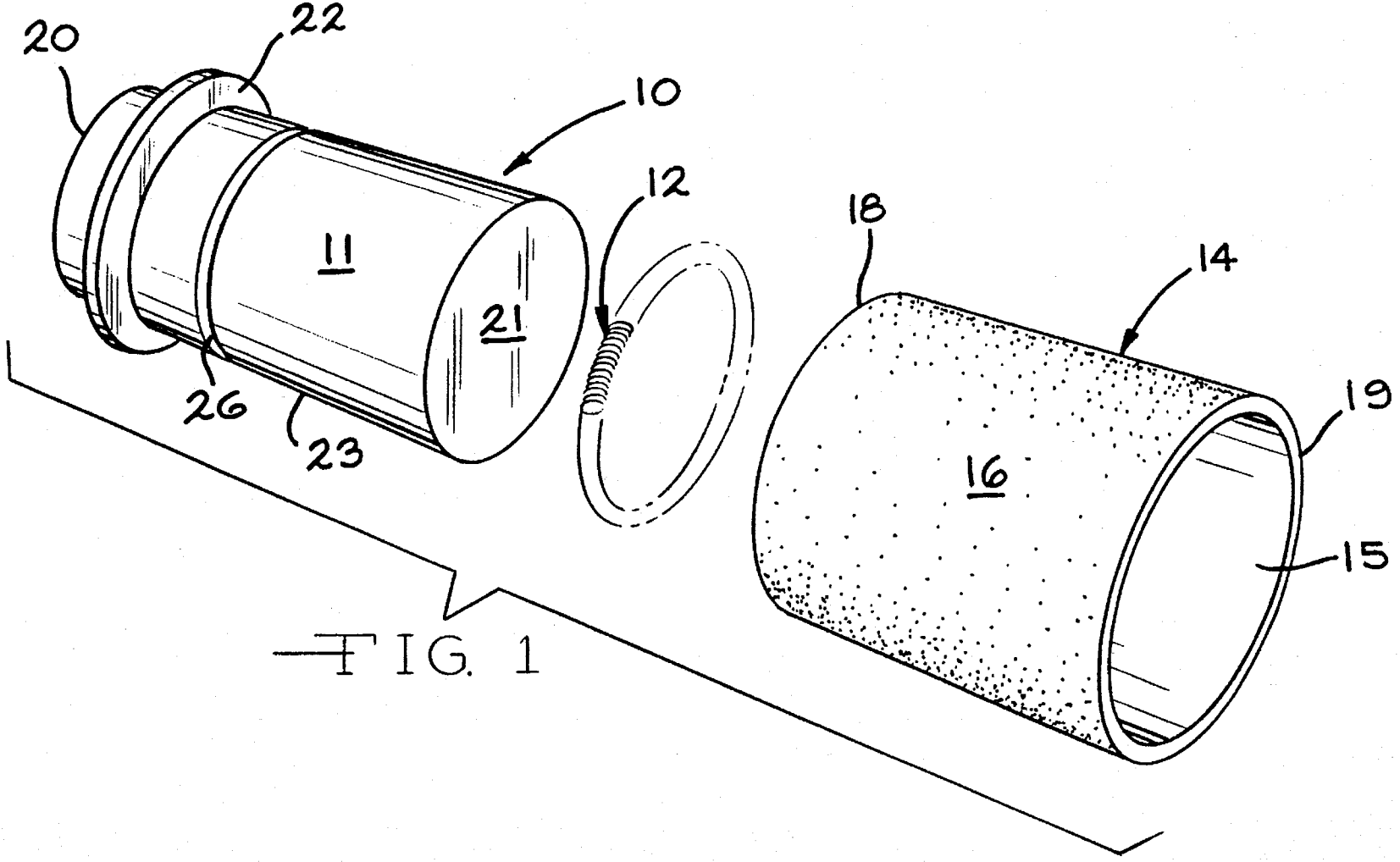
FIG. 1 is an exploded perspective view of one embodiment showing a mandrel having an outwardly facing annular groove, a canted coil spring and a liner intended to be cast in the engine block to form a liner for the cylinder bores.

U.S. Pat. No. 4,981,168, of which the inventor of the present application is a co-inventor, discloses a casting die for a cylinder in which a hollow cylindrical mandrel supported on a dowel cooperates with other portions of the casting die to support an expendable core around the mandrel. U.S. Pat. No. 4,981,168 is incorporated herein by reference.

Referring to FIGS. 1–5, there is provided a mandrel 10, a canted coil spring 12 having a garter-type shape and a cylindrical liner 14 in the form of a sleeve. The liner 14 is manufactured from steel or other suitable material capable of withstanding the heat, friction and other demands encountered in a cylinder of an internal combustion engine. The liner 14 has a smooth cylindrical interior surface 15 adapted to slidingly receive a reciprocating piston of an internal combustion engine in snug sliding engagement therewith. The liner 14 has an exterior surface 16 which will be engaged by molten metal during the casting operation to retain the liner 14 in the cast part. The liner 14 extends from a first end 18 to a second end 19 and is cylindrical throughout the entire length.

The mandrel 10 extends along an axis A from a first open end 20 to a second closed end defined by a lateral wall 21. A flange 22 extends radially outwardly from an area spaced a small distance from the open end 20.

The mandrel includes a wall 11 having a generally cylindrical exterior surface 23 extending from the lateral wall 21 to the flange 22 and an interior surface 24 which is cylindrical throughout a major portion of its length in the area inwardly from the open end 20. An outwardly facing annular groove 26 is formed in the wall 11 and extends inwardly from the exterior surface 23 by a predetermined distance. The groove 26 has a bottom 26A generally parallel to the axis A and a pair of spaced apart side walls 26B and 26C extending radially outwardly from the bottom 26A.

Positioned in the annular groove 26 is the canted coil spring 12. One such canted coil spring is one manufactured and sold by Bal Seal Engineering Company, Inc., Santa Ana, Calif., as its Series 106 Canted Coil Radial Spring. A detailed description of canted coil springs may be obtained from the following U.S. Pat. Nos. 4,655,462; 4,804,290; 4,906,109, incorporated herein by reference. The canted coil spring 12 is a continuous garter-type spring.

Figure 2:
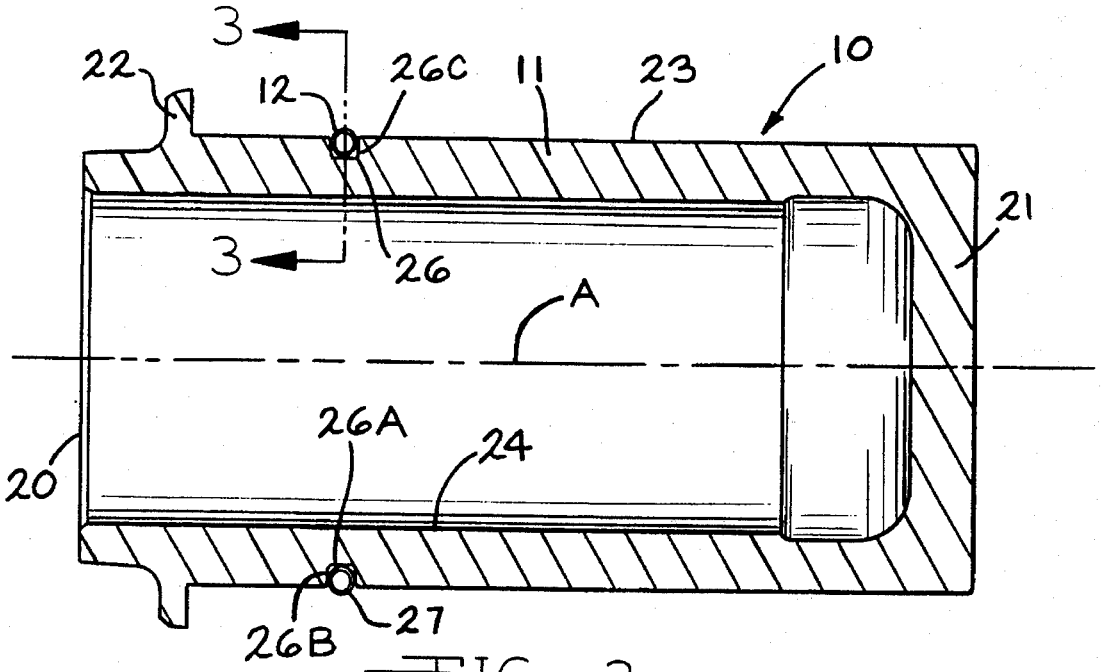
FIG. 2 is a sectional view showing the mandrel with a canted coil spring positioned in the outwardly facing groove.
Figure 3:
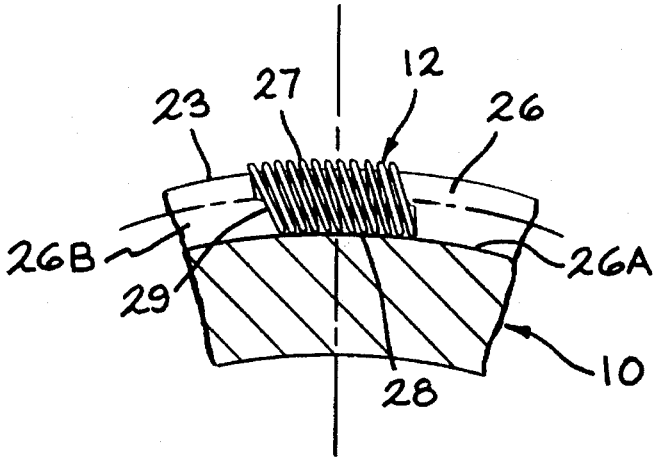
FIG. 3 is a sectional view, greatly enlarged, taken through line 3—3 of FIG. 2.

As can be seen in FIGS. 2 and 3, the canted coil spring 12 includes coils 29 having outer contact points 27 and inner contact points 28. The inner contact points 28 bear against the bottom 26A of the groove 26 and the outer contact points 27 extend outwardly a predetermined distance beyond the exterior surface 23 of the mandrel 10. For the purposes intended under the present invention of retaining a liner 14 having a weight of approximately 2-½ pounds on a mandrel 10 in which the exterior surface 23 of the mandrel has a diameter in the range of 3.136 inches ±0.001 inch, the optimum spring using a wire diameter of 0.0160 inch is wound such that its free, uncompressed coil height is approximately 0.163 inch and its width is approximately 0.182 inch. Thus, the outer contact points 27 when the spring 12 is in the uncompressed state will extend approximately 0.023 inch beyond the exterior surface 23. The diameter of the groove bottom 26A is 2.856 inches ±0.001 with the result that the depth of the groove from the exterior surface 23 to the groove bottom 26A is 0.140 inch. The width of such groove between side walls 26B and 26C is 0.190 inch ±0.001 inch which is slightly wider than the 0.182 inch width of the canted coil spring 12. As will be appreciated, a heavier weight liner will require that the spring have a larger wire diameter.

Figure 4:
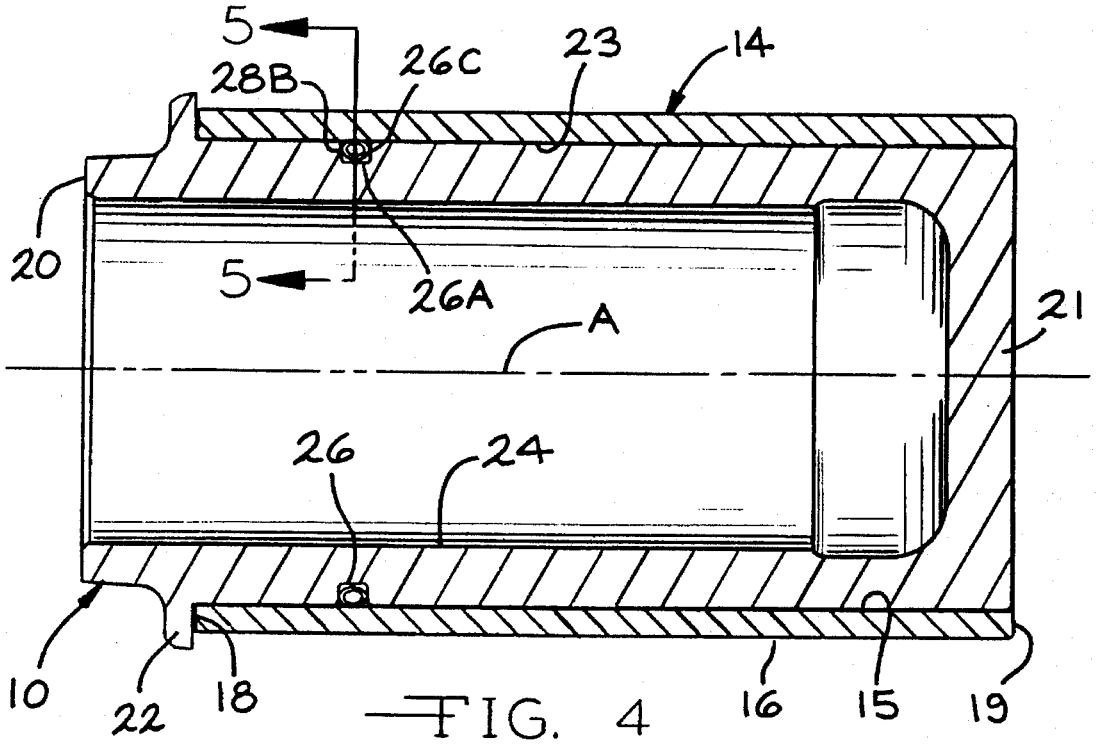
FIG. 4 is a sectional view showing the mandrel and canted coil spring of FIG. 2 with a liner positioned thereon.
Figure 5:
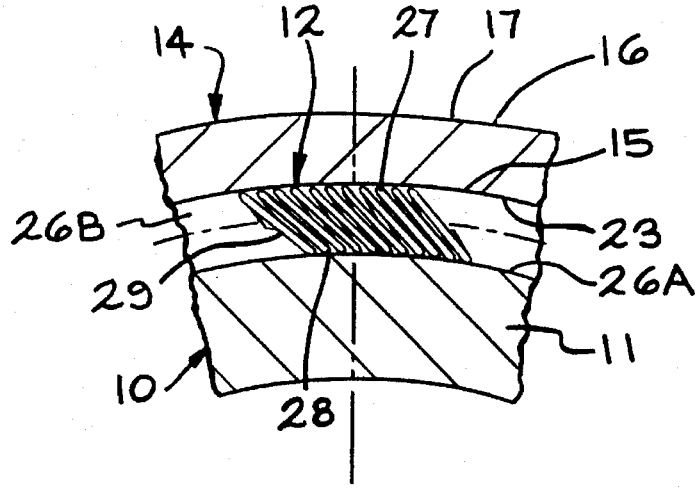
FIG. 5 is a sectional view, greatly enlarged, taken through line 5—5 of FIG. 4.
Figure 6:
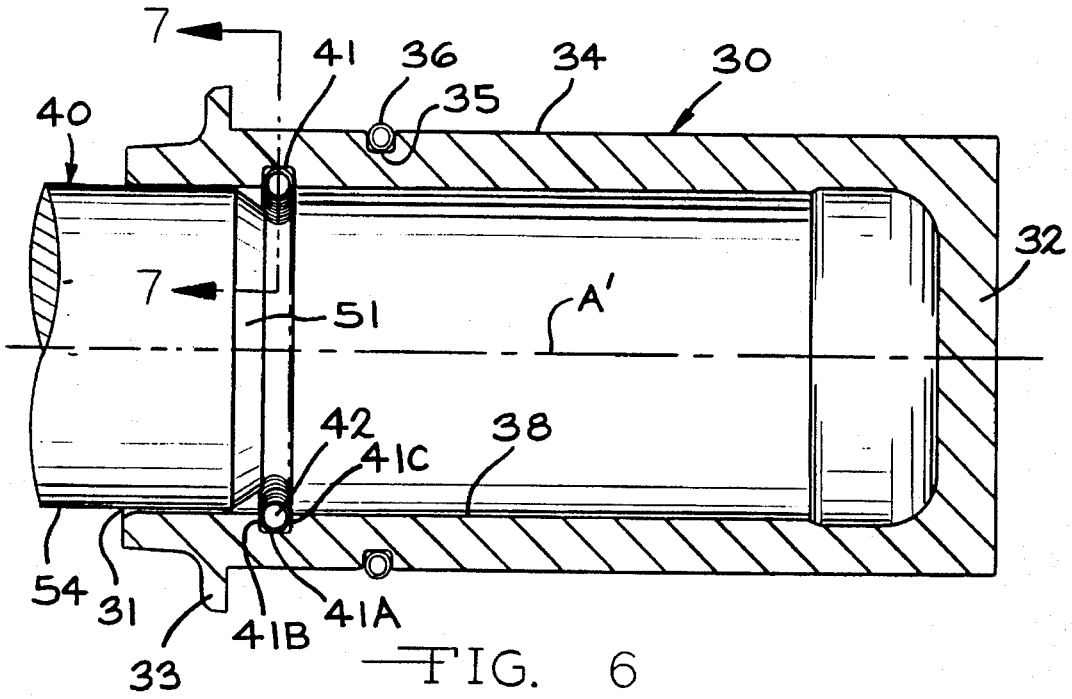
FIG. 6 is a view partly in section showing a mandrel with a second coil spring positioned in a second, inwardly facing annular groove formed in the wall of the mandrel and with the mandrel about to be positioned on a dowel.

As may be seen in FIGS. 4 and 5 by sliding the liner 14 over the mandrel 10, it will, upon making contact with the canted coil spring 12 cause such canted coil spring to be deflected from the uncompressed angle shown in FIG. 3 to a compressed angle as shown in FIG. 5. As a result, the canted coil spring 12 will impart a force acting outwardly against the interior surface 15 of the liner 14 such that the outer contact points 27 frictionally engage the liner 14 and support it on the mandrel 10 throughout the die casting operation. Following the die casting operation, the mandrel 10 may be withdrawn from the sleeve 14 by movement along the axis A carrying with it the canted coil spring 12. Such withdrawal will not damage the spring 12 or the sleeve 14 or the engagement of the sleeve with the newly cast engine block.

Tests have confirmed that the optimal force for retaining the liners 14 having a weight of approximately 2-½ pounds on the mandrel 10 throughout the casting operation while permitting the liners to be placed on the mandrel without damaging either the liners 14 or the canted coil springs 12 may be achieved by a combination of a canted coil spring and a mandrel and annular groove of the above specified dimensions.

As will be readily appreciated, in die casting engine blocks having cylinder bores having smaller or larger diameters, appropriate adjustments will have to be made in the sizes of the liners, mandrels and the canted coil springs.

Referring now to FIGS. 6–9, there is provided another embodiment in which a mandrel 30 extends along an axis A' from an open end 31 to a closed end defined by a lateral wall 32. As in the previous embodiment, the mandrel 30 has a flange 33 extending radially outwardly in an area spaced a short distance from the open end 31. Additionally, as in the previous embodiment, the mandrel 30 has a cylindrical exterior surface 34 extending from the lateral wall 32 to the flange 33. An outwardly facing angular groove 35 is formed in the mandrel 30 extending inwardly from the exterior surface 34. A canted coil spring 36 is positioned in the groove 35. The dimensions of the groove 35 and of the canted coil spring 36 are identical to the annular groove 26 and canted coil spring 12 of the embodiment of FIGS. 1–5. The canted coil spring 36 functions to hold the liner 14 on the mandrel as in the embodiment of FIGS. 1–5.

The mandrel 30 is provided with an interior surface 38 which is generally cylindrical throughout a major portion of its length from the open end 31 and is adapted to receive therein a dowel 40 intended to support the mandrel 30. An inwardly facing annular groove 41 is formed in the mandrel wall. The groove 41 extends outwardly from the interior surface 38 a predetermined depth as measured from groove bottom 41A to the interior surface 38. The groove 41 has a predetermined width as measured between the side walls 41B and 41C. Positioned in the inwardly facing annular groove 41 is a canted coil spring 42 outer contact points 47 of which engage the groove bottom 41A. The dimensions of the groove 41 and of the canted coil spring 42 are such as to provide the force and frictional resistance necessary for supporting the weight of both the liner and the mandrel 30 itself. Thus, the height of the spring 42 in the uncompressed state is greater than the depth of the groove 41 with the result that inner contact points 48 extend inwardly from interior surface 38 of the mandrel 30. The wire diameter for spring 42 was increased to 0.02 inch to accommodate holding the additional weight of the mandrel and liner. Additionally, the circumferential diameter of the spring 42 was reduced from that of the spring 36 to accommodate the smaller diameter of the groove 41.

Figure 7:
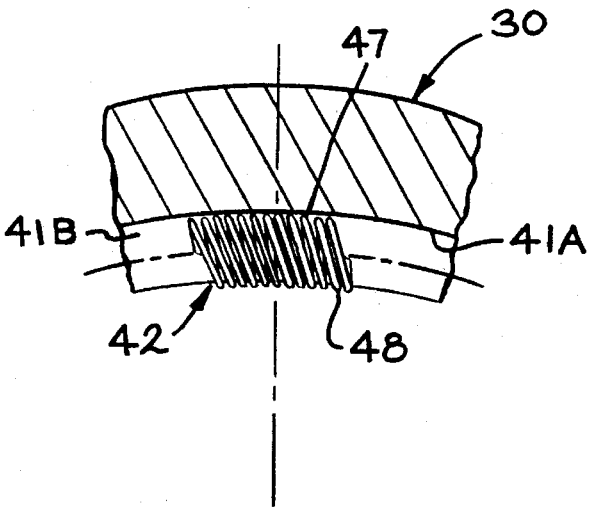
FIG. 7 is a sectional view, greatly enlarged, taken through line 7—7 of FIG. 6.
Figure 8:
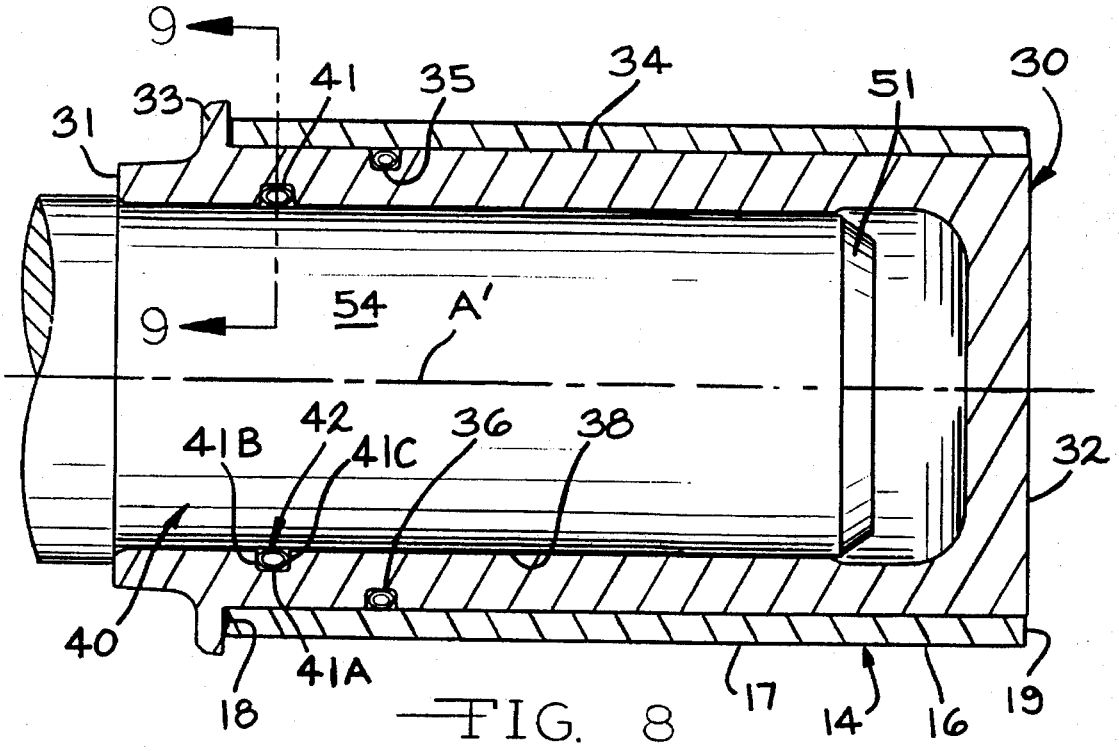
FIG. 8 is a view similar to FIG. 6 showing the mandrel completely on the dowel and retained thereon by frictional engagement of the canted coil spring.
Figure 9:
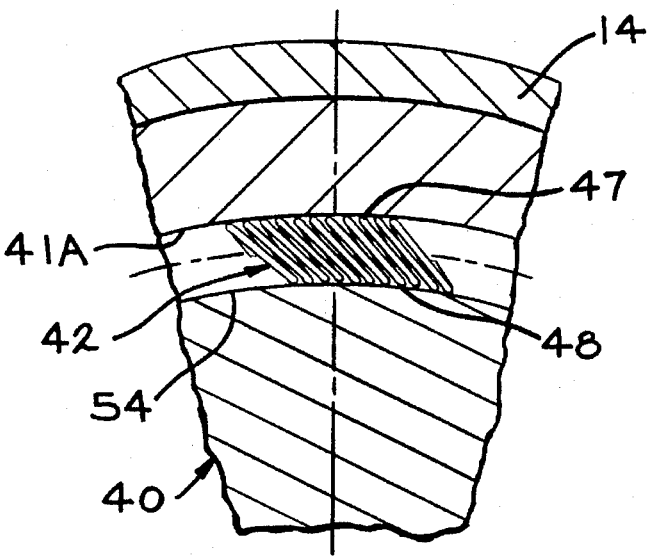
FIG. 9 is a sectional view, greatly enlarged, taken through line 9—9 of FIG. 8.

The dowel 40 has an exterior surface portion 54 which is cylindrical and of a size to be received in the open end of the mandrel 30 in snug sliding engagement with the cylindrical interior surface 38 and an outwardly tapered lead-in surface 51 at its leading end which functions to act against the canted coil spring 42 moving it from an uncompressed position shown in FIG. 7 to a compressed position shown in FIG. 9. Upon insertion of the dowel 40 into the mandrel 30 to the position shown in FIG. 8, the tapered lead-in surface 51 and then the exterior surface portion 54 will engage and compress or deflect canted coil spring 42 thereby causing the mandrel 30 to be frictionally retained on the dowel 40 by the force imparted by the outer contact points 47 against the exterior surface portions 54.

Although the present invention has been described in conjunction with die casting, it should be understood that it could be used with other types of casting operations including low pressure casting, sand casting and permanent mold casting.

Modifications to the present invention will be readily apparent to those skilled in the art. Accordingly, the scope of the present invention should be limited only by the scope of the claims.

I claim:

1. A method for casting an engine block having at least one cylindrical bore formed therein, said bore having a separately formed liner retained therein, comprising the steps of:

(a) providing (i) a mandrel extending along an axis from a first end to a second end, said mandrel including a wall having a cylindrical exterior surface extending from said first end toward said second end, said wall having an outwardly facing annular groove positioned such that portions of said cylindrical exterior surface are located between said first end and said annular groove and between said second end and said annular groove, said annular groove extending inwardly from said cylindrical exterior surface toward said axis to a bottom, (ii) a canted coil spring positioned in said outwardly facing annular groove, said spring including a series of coils, each said coils having an inner contact point in contact with said bottom and an outer contact point extending radially outwardly beyond said cylindrical exterior surface, and (iii) a liner having a cylindrical interior surface sized to permit said liner to be slidingly positioned on said mandrel in close engagement with said cylindrical exterior surface;

(b) moving said liner onto said mandrel first end in sliding engagement with said exterior surface, engaging said spring and continuing movement of said liner on said mandrel toward said second end to compress said spring and deflect said outer contact points inwardly toward said axis, said spring imparting an outwardly directed force around an annular portion of said liner interior surface providing frictional resistance between said spring, including said outer contact points, and said liner interior surface to retain said liner on said mandrel;

(c) casting molten metal around said mandrel supported liner to form a cast part while retaining said liner On said mandrel; and (d) withdrawing said mandrel and said spring from said liner while leaving said liner retained in said cast part.

2. The method according to claim 1, wherein said mandrel and said liner retained thereon are disposed in a position approximating vertical at some time between the time of positioning said liner thereon and completion of casting said cast part.

3. The method according to claim 1, wherein said mandrel has a cylindrical interior surface portion extending from said second end toward said first end and an inwardly facing annular groove spaced from said second end, said inwardly facing annular groove extending outwardly from said cylindrical interior surface portion away from said axis to a bottom, and further including the steps of:

(a) positioning a second canted coil spring in said inwardly facing annular groove, said second canted coil spring having outer contact points contacting said inwardly facing annular groove bottom and inner contact points extending inwardly from said cylindrical interior surface portion toward said axis;

(b) providing a dowel having a cylindrical exterior surface portion with a size permitting it to be engaged to said mandrel in sliding engagement with said cylindrical interior surface portion;

(c) sliding said dowel into said mandrel to engage said second canted coil spring and continuing said movement to compress said second canted coil spring and deflect said inner contact points outwardly away from said axis, said second canted coil spring imparting an inwardly directed force against said dowel cylindrical exterior surface providing frictional resistance between said inner contact points and said dowel cylindrical exterior surface to retain said mandrel on said dowel; and (d) maintaining said mandrel on said dowel supported solely by said compressed second canted coil spring and frictional forces between said mandrel cylindrical interior surface portion and said dowel cylindrical exterior surface portion throughout the step of casting said molten metal.

4. The method according to claim 3, wherein said dowel, mandrel and liner are disposed in a position approximating vertical at some time between the time of positioning said mandrel on said dowel and completion of casting said cast part.

5. The method according to claim 3, wherein said series of coils of said canted coil spring positioned in said outwardly facing annular groove have a predetermined wire diameter and said second canted coil spring has a series of coils with a wire diameter greater than said predetermined wire diameter.

6. In a method for casting metals around an article having a bore extending along a central axis and defined at least in part by an interior cylindrical wall portion wherein said article, at some phase of the process, is positioned with said central axis substantially vertical, the improvement comprising (a) providing (i) a mandrel having a cylindrical exterior surface portion, said cylindrical exterior surface portion being sized to be slidingly positioned in said bore in close relationship with said interior cylindrical wall portion and having an annular groove extending inwardly from said cylindrical exterior surface portion to a bottom, and (ii) a canted coil spring positioned in said annular groove, said spring including a series of coils having inner contact points in contact with said bottom and a series of outer contact points extending radially outwardly beyond said cylindrical exterior surface portion;

(b) moving said article onto said mandrel, engaging said spring and continuing movement of said article on said mandrel to compress said spring and deflect said outer contact points inwardly toward said axis, said spring imparting an outwardly directed force to said article interior cylindrical wall portion to provide frictional resistance between said spring, including said outer contact points, and said interior cylindrical wall portion to retain said article on said mandrel;

(c) casting molten metal around said mandrel supported article to form a cast part; and (d) withdrawing said mandrel and said spring from said article while leaving said article retained in said cast part.

7. The method according to claim 6, wherein said mandrel has a cylindrical interior surface portion and an inwardly facing annular groove, said inwardly facing annular groove extending outwardly from said cylindrical interior surface portion to a bottom, and further including the steps of:

(a) positioning a second canted coil spring in said inwardly facing annular groove, said second canted coil spring having outer contact points contacting said inwardly facing annular groove bottom and inner contact points extending inwardly from said cylindrical interior surface portion;

(b) providing a dowel having a cylindrical exterior surface portion with a size permitting it to be engaged to said mandrel in sliding engagement with said cylindrical interior surface portion;

(c) sliding said dowel into said mandrel to engage said second canted coil spring and continuing said movement to compress said second canted coil spring and deflect said inner contact points outwardly, said second canted coil spring imparting an inwardly directed force against said dowel cylindrical exterior surface portion providing frictional resistance between said inner contact points and said dowel cylindrical exterior surface portion to retain said mandrel on said dowel; and (d) maintaining said mandrel on said dowel supported solely by said compressed second canted coil spring and frictional forces between said mandrel cylindrical interior surface portion and said dowel cylindrical exterior surface portion throughout the step of casting said molten metal.

8. In a process for casting metals to form a part, the improvement comprising:

(a) providing (i) a mandrel having a cylindrical interior surface portion and an inwardly facing annular groove, said inwardly facing annular groove extending outwardly from said cylindrical interior surface portion to a bottom;

(ii) a canted coil spring in said inwardly facing annular groove, said canted coil spring having outer contact points contacting said inwardly facing annular groove bottom and inner contact points extending inwardly from said cylindrical interior surface portion;

(iii) a dowel having a cylindrical exterior surface portion with a size permitting it to be engaged to said mandrel in sliding engagement with said cylindrical interior surface portion;

(b) sliding said dowel into said mandrel to engage said canted coil spring and continuing said movement to compress said canted coil spring and deflect said inner contact points outwardly, said canted coil spring imparting an inwardly directed force against said dowel cylindrical exterior surface portion providing frictional resistance between said inner contact points and said dowel cylindrical exterior surface portion to retain said mandrel on said dowel;

(c) casting molten metal to form said part; and (d) maintaining said mandrel on said dowel supported solely by said compressed canted coil spring and frictional forces between said mandrel cylindrical interior surface portion and said dowel cylindrical exterior surface portion throughout the step of casting said molten metal.

9. The method according to claim 8, wherein said dowel and said mandrel retained thereon are disposed in a position approximating vertical at some time between the time of positioning said mandrel on said dowel and completion of casting said cast part.

10. A method for casting a metal part comprising the steps of.

(a) providing (i) a mandrel extending along an axis from a first end to a second end, said mandrel including a wall having an exterior surface and an interior surface including a cylindrical interior surface portion extending from said second end toward said first end and an inwardly facing annular groove spaced from said second end, said inwardly facing annular groove extending outwardly from said cylindrical interior surface portion away from said axis to a bottom, (ii) a canted coil spring positioned in said inwardly facing annular groove, said canted coil spring having outer contact points contacting said inwardly facing annular groove bottom and inner contact points extending inwardly from said cylindrical interior surface portion toward said axis; and (iii) a dowel having a cylindrical exterior surface portion with a size permitting it to be engaged to said mandrel in sliding engagement with said cylindrical interior surface portion;

(b) sliding said dowel into said mandrel to engage said canted coil spring and continuing said movement to compress said canted coil spring and deflect said inner contact points outwardly away from said axis, said canted coil spring imparting an inwardly directed force against said dowel cylindrical exterior surface providing frictional resistance between said inner contact points and said dowel cylindrical exterior surface to retain said mandrel on said dowel;

(c) casting molten metal to form said part; and (d) maintaining said mandrel on said dowel supported solely by said compressed canted coil spring and frictional forces between said mandrel cylindrical interior surface portion and said dowel cylindrical exterior surface portion throughout the step of casting said molten metal.

11. The method according to claim 10, wherein said dowel and mandrel are disposed in a position approximating vertical at some time between the time of positioning said liner thereon and completion of casting said cast part.

12. A die casting apparatus for use in casting metal parts comprising:

(a) a mandrel located within a mold cavity in said casing apparatus and extending along an axis from a first end to a second end, said mandrel including a wall having a cylindrical exterior surface extending from said first end toward said second end, said wall having an outwardly facing annular groove positioned such that portions of said cylindrical exterior surface are located between said first end and said annular groove and between said second end and said annular groove, said annular groove extending inwardly from said exterior surface toward said axis to a bottom, (b) a canted coil spring positioned in said outwardly facing annular groove, said spring being resiliently compressible and including a series of coils having inner contact points in contact with said bottom and a series of outer contact points which extend radially outwardly beyond said cylindrical exterior surface when said spring is not compressed; and (c) a liner having a cylindrical interior surface sized to permit said liner to be slidingly positioned on said mandrel in close engagement with said cylindrical exterior surface, said liner positioned on said mandrel in a position engaging and compressing said spring such that said outer contact points engage said liner interior surface, said spring imparting an outwardly directed force to said liner interior surface to provide frictional resistance between said spring including said outer contact points and said liner interior surface to retain said liner on said mandrel.

13. Apparatus according to claim 12, wherein said mandrel has a cylindrical interior surface portion extending from said second end toward said first end and an inwardly facing annular groove spaced from said second end, said inwardly facing annular groove extending outwardly from said cylindrical interior surface portion away from said axis to a bottom, and further including:

(a) a second canted coil spring in said inwardly facing annular groove, said second canted coil spring having outer contact points contacting said inwardly facing annular groove bottom and inner contact points extending inwardly from said cylindrical interior surface portion when said second spring is not compressed; and (b) a dowel having a cylindrical exterior surface portion with a size permitting it to be engaged to said mandrel in sliding engagement with said cylindrical interior surface portion, said dowel positioned in said mandrel in a position engaging and compressing said second canted coil spring such that said inner contact points engage said dowel cylindrical exterior surface, said second canted coil spring imparting an inwardly directed force against said dowel cylindrical exterior surface providing frictional resistance between said inner contact points and said dowel cylindrical surface to retain said mandrel on said dowel.

14. Apparatus according to claim 13, wherein said series of coils of said canted coil spring positioned in said outwardly facing annular groove have a predetermined wire diameter and said second canted coil spring has a series of coils with a wire diameter greater than said predetermined diameter.

15. A die casting apparatus for use in casting metal parts comprising:

(a) a mandrel located within a mold cavity in said casting apparatus and extending along an axis from a first end to a second end, said mandrel including a wall having a cylindrical exterior surface extending from said first end toward said second end, a cylindrical interior surface portion extending from said second end toward said first end and an inwardly facing annular groove spaced from said second end, said inwardly facing annular groove extending outwardly from said cylindrical interior surface portion away from said axis to a bottom;

(b) a canted coil spring in said inwardly facing annular groove, said canted coil spring having outer contact points contacting said inwardly facing annular groove bottom and inner contact points extending inwardly from said cylindrical interior surface portion when said spring is not compressed; and (c) a dowel having a cylindrical exterior surface portion with a size permitting it to be engaged to said mandrel in sliding engagement with said cylindrical interior surface portion, said dowel positioned in said mandrel in a position engaging and compressing said canted coil spring such that said inner contact points engage said dowel cylindrical exterior surface, said canted coil spring imparting an inwardly directed force against said dowel cylindrical exterior surface providing frictional resistance between said inner contact points and said dowel cylindrical surface to retain said mandrel on said dowel.

* * * * *